US005322447A

United States Patent [19]

Okada

[11] Patent Number: 5,322,447

[45] Date of Patent: Jun. 21, 1994

[54] PRINTED BOARD CONNECTOR

[75] Inventor: Yoshikatsu Okada, Tokyo, Japan

[73] Assignee: NEC Corporation, Tokyo, Japan

[21] Appl. No.: 32,188

[22] Filed: Mar. 15, 1993

Related U.S. Application Data

[63] Continuation of Ser. No. 767,780, Sep. 30, 1991, abandoned.

[30] Foreign Application Priority Data

Sep. 28, 1990 [JP] Japan ..... 2-102495

[51] Int. Cl.[5] ..... H01R 9/09

[52] U.S. Cl. ..... 439/79; 439/540

[58] Field of Search ..... 439/55, 59, 60, 78, 439/79, 80, 540

[56] References Cited

U.S. PATENT DOCUMENTS

| | | | |
|---|---|---|---|
| 3,905,673 | 9/1975 | Evans et al. . | |
| 4,659,155 | 4/1987 | Walkup et al. | 439/79 X |
| 4,790,760 | 12/1988 | Kreinberg | 439/59 X |
| 4,887,353 | 12/1989 | Preputnick | 439/79 X |
| 4,909,743 | 3/1990 | Johnson et al. . | |
| 4,936,785 | 6/1990 | Krug et al. | 439/59 X |
| 5,017,146 | 5/1991 | Uehara et al. | 439/60 X |
| 5,053,926 | 10/1991 | Dickie | 439/79 X |

FOREIGN PATENT DOCUMENTS

| | | |
|---|---|---|
| 0273589 | 7/1988 | European Pat. Off. . |
| 57-7177 | 1/1982 | Japan . |

OTHER PUBLICATIONS

Ueno et al., "Development of ISDN Terminal Adaptor Compatible with CCITT vol. 110 and vol. 120 Rate Adaptations", NEC Res. & Develop., vol. 32, No. 2, Apr. 1991, pp. 262–269.

*Primary Examiner*—Khiem Nguyen

*Attorney, Agent, or Firm*—Sughrue, Mion, Zinn, Macpeak & Seas

[57] ABSTRACT

According to this invention, a printed board connector includes a first connector, a second connector, and a third connector. The first connector is mounted on an upper surface of an edge portion of a printed board and constituted by a first housing and a first contact. The second connector is mounted on a lower surface of the edge portion of the printed board at an opposite position of the first connector with respect to the printed board and constituted by a second housing and a second contact. The third connector is constituted by a third contact formed on one of the upper and lower surfaces of the edge portion of the printed board by a conductive metal layer and a third housing formed by opposite side surfaces of the first and second housings.

7 Claims, 3 Drawing Sheets

PRINTED BOARD CONNECTOR

This is a Continuation of Application No. 07/767,780 filed Sep. 30, 1991 now abandoned.

BACKGROUND OF THE INVENTION

The present invention relates to a mounting structure of a connector for a printed board used in an electric equipment or the like and, more particularly, to the structure of an edge connector mounted on an edge side of a printed board.

In a conventional printed board used in an electric equipment or the like, the following connecting method is often employed. That is, a connector is mounted on an edge side of a printed board, and a cable from an external equipment is connected to the connector. In recent years, as a mounting density is increased, a plurality of connectors must be mounted on an edge side.

As a mounting method, a mounting structure disclosed in Japanese Utility Model Laid-Open No. 57-7177 is known. That is, in this mounting structure, as shown in FIG. 4, a first-stage connector 11, a second-stage connector 12, and a third-stage connector 13 each having a housing 15 and a plurality of pin contacts 14 are stacked on a printed board 16.

In the above conventional connector mounting structure, since the connectors are independently stacked, the height of the mounted connectors and an area for mounting the connectors are disadvantageously increased. In addition, in the second- and third-stage connectors, since the conductor lengths of contacts are increased, the following drawbacks are caused by an increase in conductor resistance. A signal is delayed, and electric noise is generated.

SUMMARY OF THE INVENTION

It is an object of the present invention to provide a printed board connector capable of increasing a mounting density of a connector.

It is another object of the present invention to provide a printed board connector capable of preventing signal delay and electric noise by decreasing a conductor length of a contact.

In order to achieve the above objects of the present invention, there is provided a printed board connector comprising a first connector mounted on an upper surface of an edge portion of a printed board and constituted by a first housing and a first contact, a second connector mounted on a lower surface of the edge portion of the printed board at an opposite position of the first connector with respect to the printed board and constituted by a second housing and a second contact, and a third connector constituted by a third contact formed on one of the upper and lower surfaces of the edge portion of the printed board by a conductive metal layer and a third housing formed by opposite side surfaces of the first and second housings.

BRIEF DESCRIPTION OF THE DRAWINGS

FIGS. 2 and 3 are sectional views along a line A—A in FIG. 1, in which FIG. 2 is a sectional view showing a case wherein connection points of three connectors have the same shape, and FIG. 3 is a sectional view showing a case wherein connection points of three connectors have different shapes.

DESCRIPTION OF THE PREFERRED EMBODIMENT

The present invention will be described below with reference to the accompanying drawings.

Figure 1:
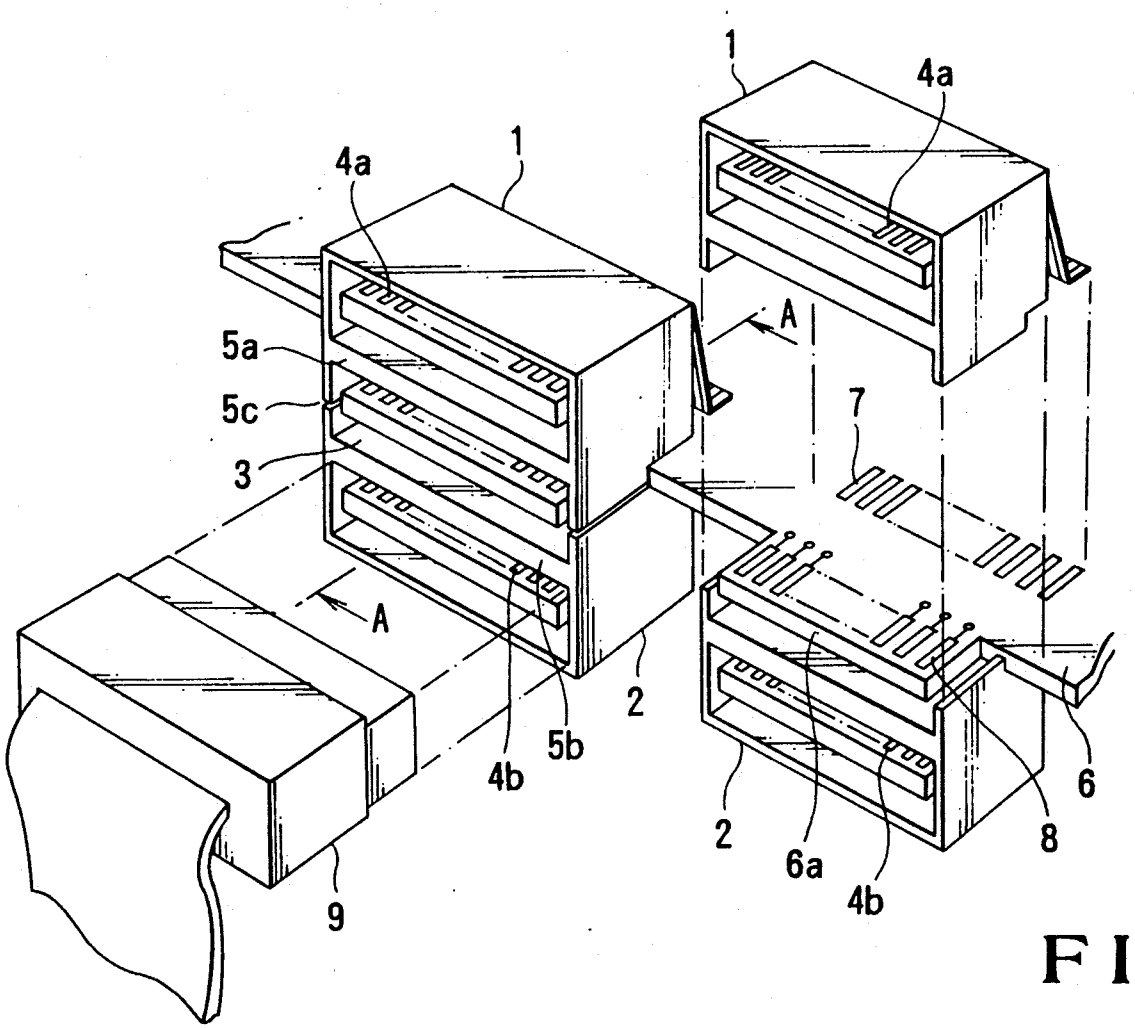
FIG. 1 is a perspective view showing an embodiment of the present invention.
Figure 2:
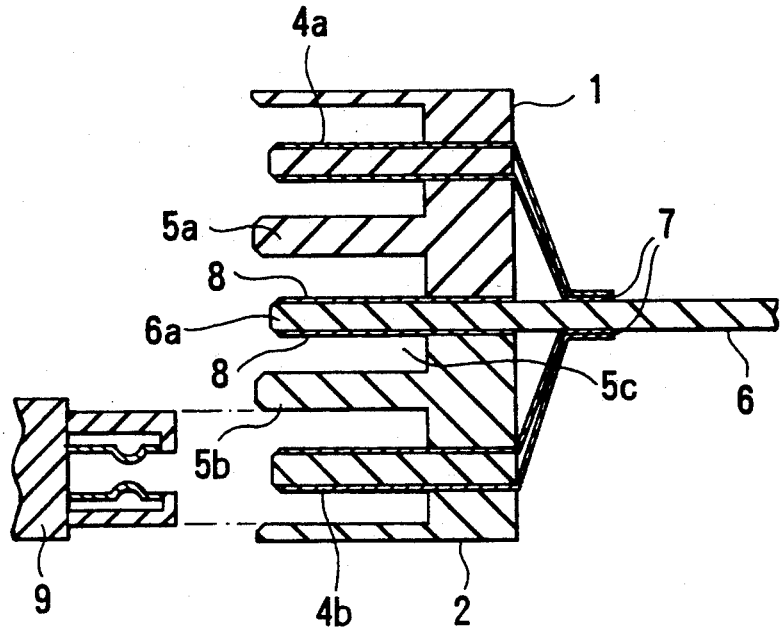
Figure 3:
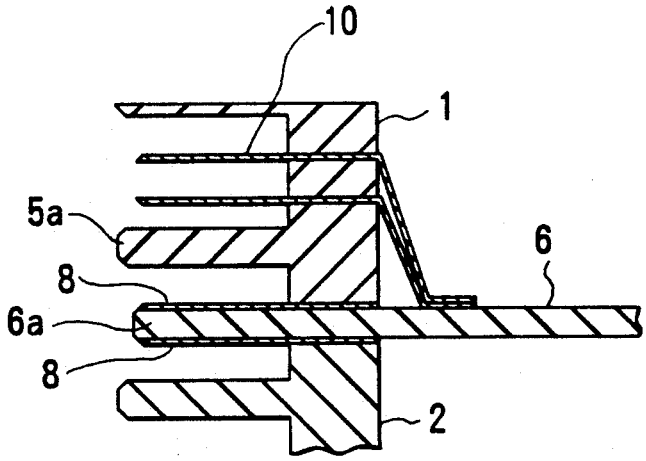
Figure 4:
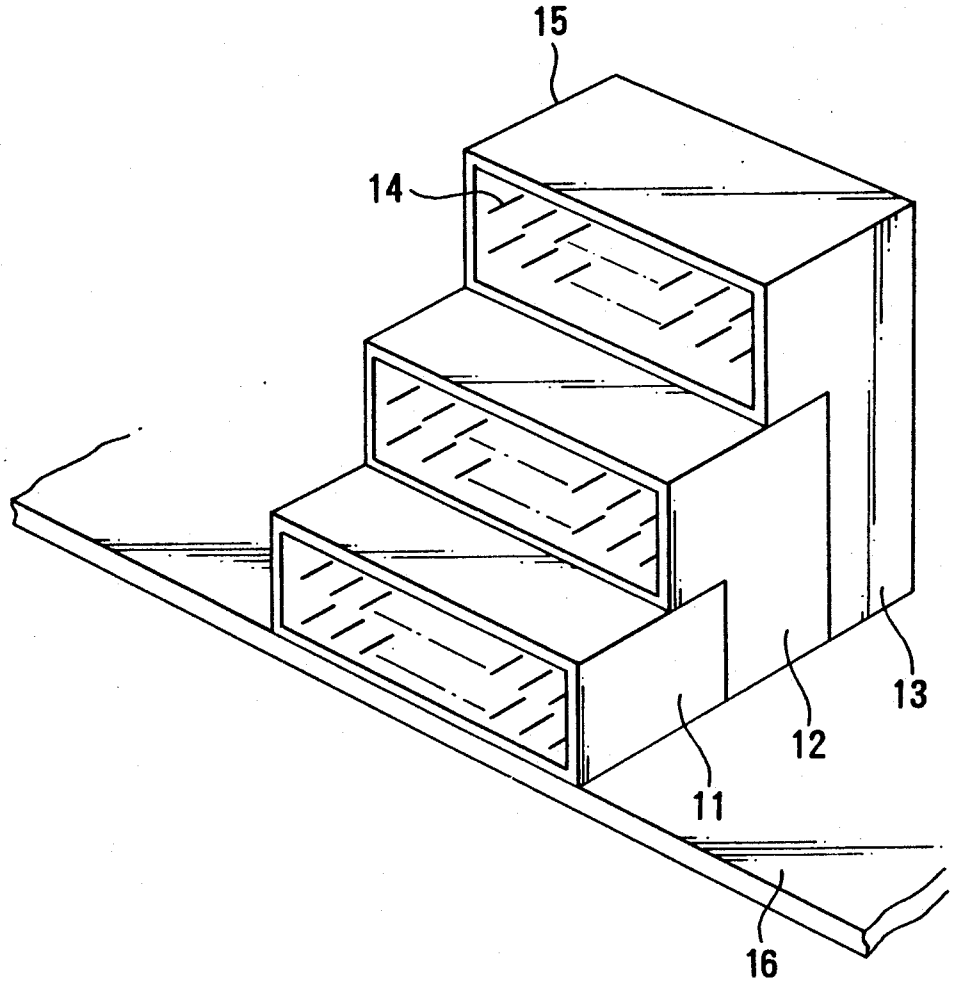
FIG.4 PRIOR ART
FIG. 4 is a perspective view showing a conventional structure in which a plurality of edge connectors are mounted.

FIG. 1 shows an embodiment of the present invention. FIG. 2 shows a case wherein connection points of three connectors have the same shape, and FIG. 3 shows a case wherein connection points of three connectors have different shapes.

According to the present invention, a third connector 3 is constituted by a first connector 1, a second connector 2, and a printed board 6. That is, the first connector 1 mounted on the upper surface of an edge portion of the printed board 6 having an ear 6*a* and the second connector 2 mounted on the lower surface of the edge portion of the printed board 6 respectively have housings 5*a* and 5*b* and pluralities of contacts 4*a* and 4*b*. The first and second connectors 1 and 2 are symmetrically mounted on the upper and rear surfaces of the edge portion of the printed board 6, and a housing 5*c* of the third connector 3 is formed by the opposite housings 5*a* and 5*b*.

Soldering pads 7 for soldering the first and second connectors 1 and 2 are arranged inward from the edge portion of the printed board 6. In addition, contact pads formed by copper foil layers on the surface of the edge portion of the printed board 6 and prospectively serving as the contacts of the third connector 3 are arranged on the edge portion of the printed board 6 and in the housing 5*c* of the third connector 3. A mating cable plug 9 is connected to the contacts 4*a* and 4*b* and the contact pad 8 formed as described above.

According to the above embodiment, since the third connector is formed by the two connectors and the printed board, the connector mounting density of the edge portion of the printed board is increased, thereby decreasing the conductor length of the contact.

As shown in FIGS. 2 and 3, the contact connection points have different shapes to obtain two types of connectors. In the structure in FIG. 2, the contacts 4*a* and 4*b* and the contact pads 8 have the same shape, the first to third connector 1, 2, and 3 are of the same type. In the structure in FIG. 3, since pin contacts 10 are used as the contacts of a first connector 1, the first connector 1 has a shape different from the shape of second and third connectors 2 and 3, and a different type of connector can be obtained.

A fourth connector having contacts may be stacked on at least one of the first and second connectors to form a multilayered structure.

In addition, a plurality of parallel printed boards are prepared, and a set of connectors having the same arrangement of that of the above first to third connectors are formed. The opposite side surfaces of the housings of the two adjacent connectors of the connector sets are integrally formed to cause the plurality of parallel boards and the plural sets of connectors to form a sandwich structure. Therefore, the present invention can also be applied to a multilayered printed board.

As described above, according to the present invention, a connector mounting density for the edge portion of a printed board can be increased, and the conductor length of a contact can be smaller than that of a contact used in a conventional structure in which three connectors are mounted on the same surface of a printed board to be stacked into three stages. In addition, variations in conductor lengths of the contacts can be minimized. Therefore, a signal delay and a difference between signal timings can be decreased, exchange of noise such as crosstalk can be minimized, and satisfactory signal connection can be achieved.

What is claimed is:

1. A printed board connector comprising:

a first connector mounted on an upper surface of an edge portion of a printed board and constituted by a first housing and a first contact;

a second connector mounted on a lower surface of the edge portion of said printed board at an opposite position of said first connector with respect to said printed board and constituted by a second housing and a second contact; and a third connector constituted by a third contact formed on one of said upper and lower surfaces of the edge portion of said printed board by a conductive metal layer and a third housing formed by symmetrically aligning said first housing with said second housing.

2. A connector according to claim 1, wherein each of said first and second contacts is constituted by a plurality of pin contacts.

3. A connector according to claim 1, wherein the edge portion of said printed board has an ear having said third contact.

4. A connector according to claim 1, wherein said first, second, and third contacts have the same shape.

5. A connector according to claim 1, wherein at least one of said first, second, and third contacts, which comprise a group of contacts, has a shape different from that of other contacts in the group.

6. A mounting structure of edge connectors on a printed board, including a plurality of contacts and a housing, comprising:

one connector portion constituted by said plurality of contacts and a rectangular housing fitting hole, said rectangular fitting hole having two divided recessed housing fitting holes, wherein said connector portion is mounted on each of upper and lower surface edges of said printed board to obtain first and second connectors mounted symmetrical with each other through said printed board, recessed housing fitting holes of said first and second connectors are opposite to each other to form a rectangular housing fitting hole of a third connector, and a copper film pad formed on said printed board serves as a contact of said third connector and extends into said housing fitting hole of said third housing.

7. A connector, to be surface-mounted at an edge of a printed board, including a plurality of contacts and a housing, said housing comprising:

a first volume enclosed on at least four sides and containing a plurality of contacts, said first volume defining a first fitting hole;

a second volume extending from one side of said first fitting hole and being enclosed on at least three sides, one of the enclosed sides of said second volume being coincident with a closed side of said first volume, and wherein an edge of said printed board may enter said second volume through an open side thereof; and a second housing, said second housing comprising a third volume enclosed on at least four sides and containing a plurality of contacts, said third volume defining a second fitting hole; and a fourth volume extending from one side of said second fitting hole and being enclosed on at least three sides, one of the enclosed sides of said fourth volume being coincident with a closed side of said third volume, said fourth volume being mateable with said second volume to form a third fitting hole, wherein said edge of said printed board may be disposed within said third fitting hole.

* * * * *